United States Patent [19]

Bares

[11] Patent Number: 4,743,936

[45] Date of Patent: May 10, 1988

[54] TRANSPORT HAVING COMPENSATION FOR MATERIAL PACKING

[75] Inventor: Jan Bares, Webster, N.Y.

[73] Assignee: Xerox Corporation, Stamford, Conn.

[21] Appl. No.: 85,504

[22] Filed: Aug. 14, 1987

[51] Int. Cl.[4] ..... G03G 15/08

[52] U.S. Cl. ..... 355/3 DD; 222/DIG. 1; 406/86; 198/659

[58] Field of Search ..... 355/3 DD, 15; 406/86; 222/413, 424, DIG. 1; 198/659; 118/653

[56] References Cited

U.S. PATENT DOCUMENTS

| | | | |
|---|---|---|---|
| 3,802,551 | 4/1974 | Somers | 198/213 |
| 3,946,910 | 3/1976 | Case | 222/238 |
| 3,967,722 | 7/1976 | Dietert | 198/213 |
| 4,142,655 | 3/1979 | Fantuzzo | 222/DIG. 1 |
| 4,639,115 | 1/1987 | Lin | 355/3 DD |

*Primary Examiner*—A. C. Prescott
*Assistant Examiner*—J. Pendergrass
*Attorney, Agent, or Firm*—H. Fleischer; J. E. Beck; R. Zibelli

[57] ABSTRACT

An apparatus in which particles are moved from one end of a duct to the other end thereof. The particles in the duct are fluidized. A pressure differential is generated which moves the fluidized particles in the duct from one end of the duct to the other end thereof. When the particles pack and cake together, the apparatus automatically moves the toner particles away from the region of the packed and caked toner particles to relieve this condition.

16 Claims, 3 Drawing Sheets

TRANSPORT HAVING COMPENSATION FOR MATERIAL PACKING

This invention relates generally to an electrophotographic printing machine, and more particularly concerns a development apparatus wherein developer material transported thereto from a remote location with material packing and caking being automatically corrected.

In an electrophotographic printing machine, a photoconductive member is charged to a substantially uniform potential to sensitize the surface thereof. The charged portion of the photoconductive member is exposed to a light image of an original document being reproduced. Exposure of the charged photoconductive member selectively dissipates the charge thereon in the irradiated areas. This records an electrostatic latent image on the photoconductive member corresponding to the informational areas contained within the original document being reproduced. After the electrostatic latent image is recorded on the photoconductive member, the latent image is developed by bringing a developer material into contact therewith. This forms a powder image on the photoconductive member which is subsequently transferred to a copy sheet. The copy sheet is heated to permanently affix the marking particles thereto in image configuration.

In the foregoing type of printing machine, a development system is employed to deposit developer material onto the electrostatic latent image recorded on the photoconductive surface. Generally, the developer material comprises toner particles adhering triboelectrically to coarser carrier granules. Typically, the toner particles are made from a thermoplastic material while the carrier granules are made from a ferromagnetic material. Alternatively, a single component magnetic material may be employed. A system utilizing a single component magnetic developer material is capable of high speeds. Thus, a single component development system readily lends itself to applications involving high speed electrophotographic printing machines. However, a large continuous supply of toner particles must be available to be capable of copying large numbers of original documents or producing multiple copies of the same original document. This is necessary in order to insure that the machine is not shut down at relatively short intervals due to the lack of toner particles. Ideally, this is achieved by utilizing a remote toner sump, a toner sump containing a large supply of toner particles, positioned remotely from the developer housing in the printing machine. The toner particles are then transported from the toner sump to the development system. However, it has been found that it is frequently difficult to locate the toner sump within the printing machine while still optimizing the printing machine architecture. This is due to the fact that the toner particles do not readily move against the gravitational force. Hence, the toner sump must be positioned above the development system. Under these circumstances, this restricts the machine architecture. Moreover, it is necessary not only to be capable of transporting magnetic particles but non-magnetic toner particles as well. Frequently, it is highly desirable to be capable of developing the latent image with insulating, non-magnetic toner particles. Insulating toner particles optimize copy quality. One of the problems of transporting toner particles from a remote location is that the toner particles pack and cake together impeding their flow. It is highly desirable that toner particle transports be capable of automatically eliminating impediments to the flow of the toner particles. The following disclosures appear to be relevant:

U.S. Pat. No. 3,802,551
Patentee: Somers
Issued: Apr. 9, 1974

U.S. Pat. No. 3,946,910
Patentee: Case
Issued: Mar. 30, 1976

U.S. Pat. No. 3,967,722
Patentee: Dietert
Issued: July 6, 1976

U.S. Pat. No. 4,639,115
Patentee: Lin
Issued: Jan. 27, 1987

U.S. patent application Ser. No. 895,543
Filed: Aug. 11, 1986
Applicant: Bares

The relevant portions of the foregoing disclosures may be briefly summarized as follows:

Somers discloses a flexible tubular conveyor having a helical screw disposed therein. A helical spring drives the screw and simultaneously reinforces the screw. The pitch of the spring may vary along the conduit by elastic deformation due to the load stresses.

Case describes a toner dispenser having a hopper with a brush mounted rotatably therein with the fibers thereof extending though the opening in the hopper for discharging toner particles therefrom A rod having pins extending outwardly therefrom is mounted rotatably in the hopper to stir the toner particles preventing clumping or caking thereof.

Dietert discloses a rotatable feed auger made from an elongated rigid, hollow cylinder having annular, exterior recesses therein. A plastic sleeve is molded on the cylinder for rotation therewith, and in such a manner that the sleeve is prevented from moving axially relative to the cylinder. A flexible, helical fin is integral with the sleeve and extends over substantially 180° of the auger.

Lin describes a cleaning system used in an electrophotographic printing machine to remove debris from toner particles. A paddle wheel is rotatably supported in the housing to move developer material contained therein.

Bares discloses an elongated member disposed in a tube having toner particles therein. The elongated member is rotated to fluidize the toner particles and a pressure gradient is generated to move the toner particles from a remote storage container to the developer unit. The elongated member may have paddles extending outwardly from a rod.

Pursuant to the features of the present invention, there is provided an apparatus arranged for use in an electrophotographic printing machine for moving developer material from a storage container located at one end of a duct to a developer unit located at the other end thereof. The apparatus includes an elongated member disposed interiorly of the duct. Means move the elongated member to fluidize the developer material in the duct. The elongated member, in response to the torque applied thereon by packing of the developer material, deflects so that continued movement of the elongated member reduces the torque applied thereon by returning the developer material to the storage container. Means normally advance the fluidized developer material in the duct from the storage container located at one end of the duct to the developer unit located at the other end of the duct.

In accordance with another aspect of the present invention, there is provided an electrophotographic printing machine of the type having an electrostatic latent image recorded on a photoconductive member in which developer material is moved from a storage container located at one end of a duct to a developer unit located at the other end thereof for development of the electrostatic latent image. The improvement in the printing machine includes an elongated member disposed interiorly of the duct. Means move the elongated member to fluidize the developer material in the duct. The elongated member, in response to the torque applied thereon by packing of the developer material, deflects so that a continued movement of said elongated member reduces the torque applied thereon by returning the developer material to the storage container. Means normally advance the fluidized developer material in the duct from the storage container located at one end of the duct to the developer unit located at the other end of the duct.

Other aspects of the present invention will become apparent as the following description proceeds and upon reference to the drawings, in which.

Figure 2:
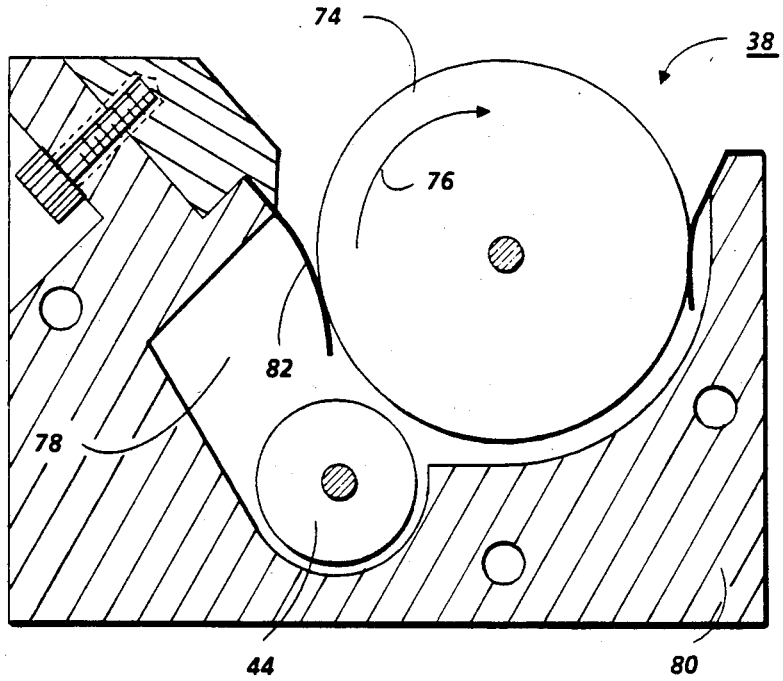
FIG. 2 is a schematic elevational view showing the development apparatus used in the FIG. 1 printing machine.
Figure 3:
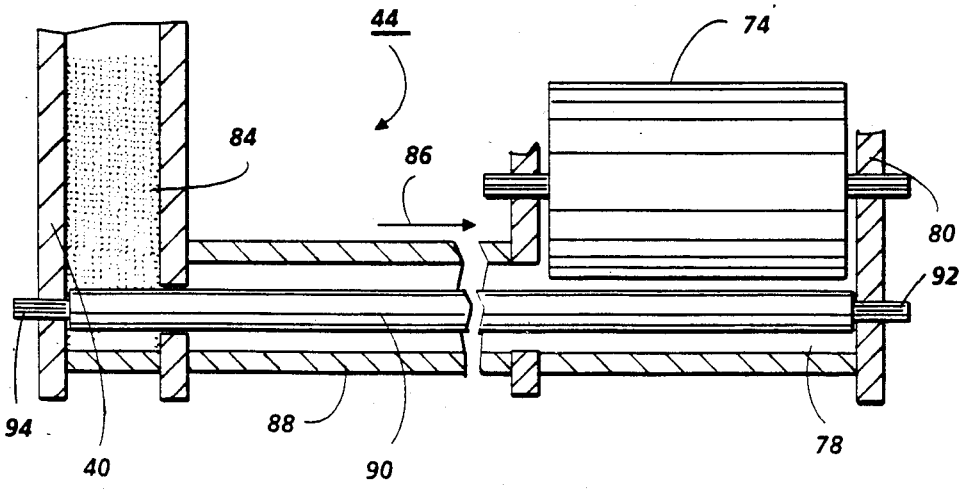
Figure 4A:
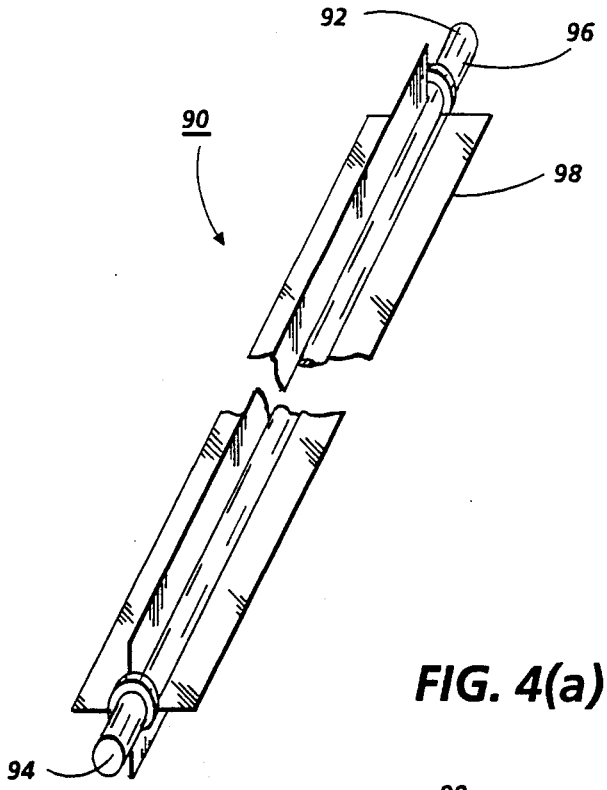
Figure 4B:
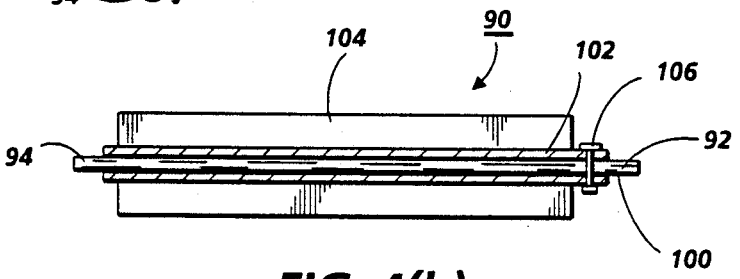
Figure 4C:
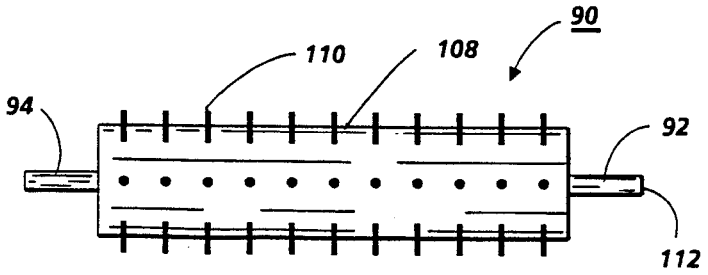

FIG. 3 is a fragmentary, sectional elevational view depicting the transport moving the particles from the remote toner container to the FIG. 2 development apparatus; and FIGS. 4 (*a*) through 4(*c*), inclusive show various types of assemblies used in the FIG. 3 transport for fluidizing the toner particles therein and automatically correcting for packing and caking of the toner particles being advanced along the duct thereof.

While the present invention will hereinafter be described in connection with various embodiments thereof, it will be understood that it is not intended to limit the invention to these embodiments. On the contrary, it is intended to cover all alternatives, modifications and equivalents that may be included within the spirit and scope of the invention as defined by the appended claims.

Figure 1:
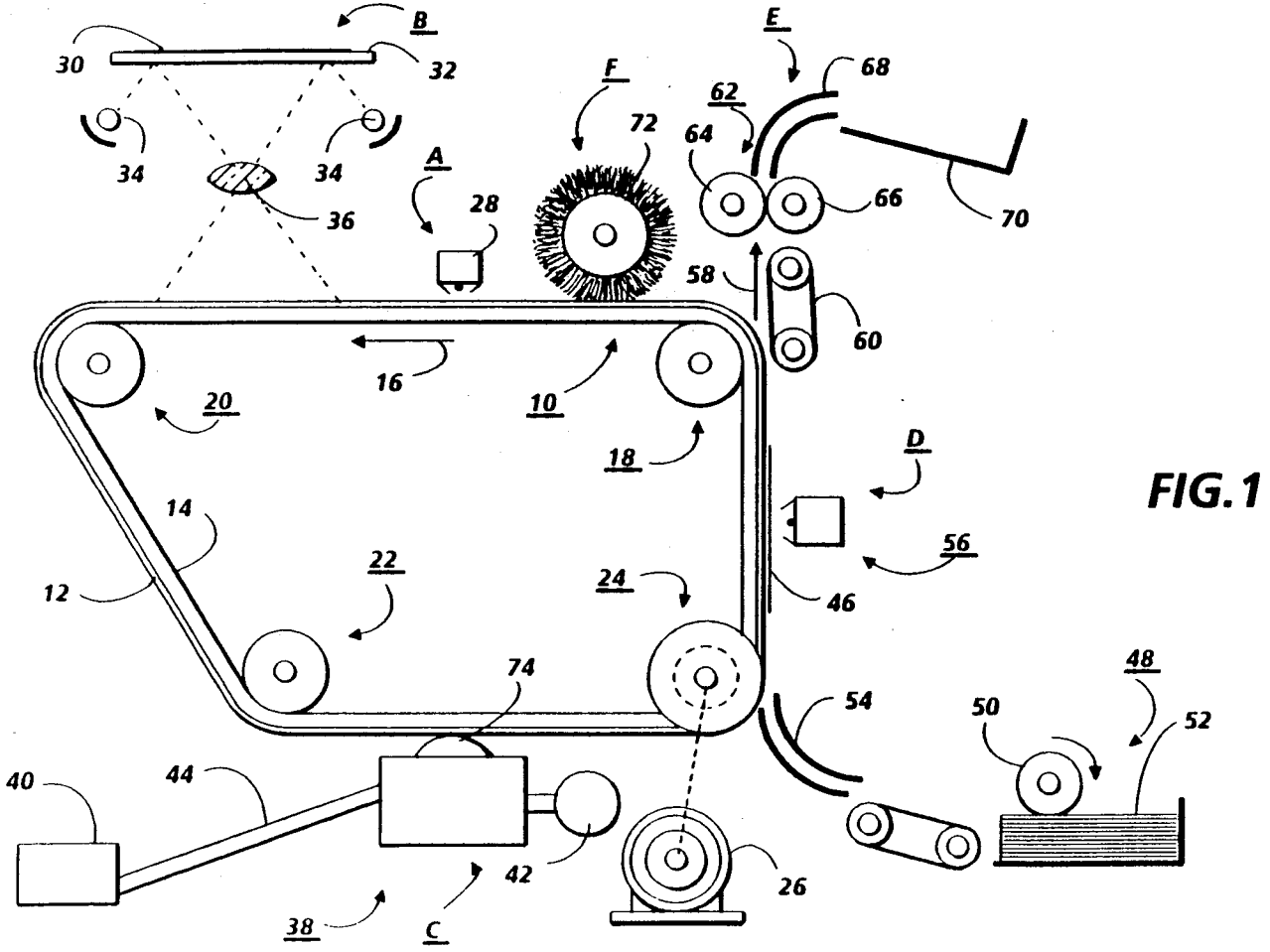
FIG. 1 is a schematic elevational view depicting an electrophotographic printing machine incorporating the development apparatus of the present invention therein.

For a general understanding of the features of the present invention, reference is made to the drawings. In the drawings, like reference numerals have been used throughout to designate identical elements. FIG. 1 schematically depicts the various elements of an illustrative electrophotographic printing machine incorporating the development system and developer material transport of the present invention therein. It will become evident from the following discussion that this apparatus is equally well suited for use in a wide variety of devices wherein material is transported from an entrance port to a discharge region and is not necessarily limited in its application to the particular embodiment depicted herein.

Inasmuch as the art of electrophotographic printing is well known, the various processing stations employed in the FIG. 1 printing machine will be shown hereinafter schematically and their operation described briefly with reference thereto.

Turning now to FIG. 1, the electrophotographic printing machine employs a belt 10 having a photoconductive surface 12 deposited on a conductive substrate 14. Preferably, photoconductive surface 12 is made from a selenium alloy with conductive substrate 14 being made from an aluminum alloy which is electrically grounded. Other suitable photoconductive surfaces and conductive substrates may also be employed. Belt 10 moves in the direction of arrow 16 to advance successive portions of photoconductive surface 12 through the various processing stations disposed about the path of movement thereof. As shown, belt 10 is entrained about rollers 18, 20, 22 and 24. Roller 24 is coupled to motor 26 which drives roller 24 so as to advance belt 10 in the direction of arrow 16. Rollers 18, 20, and 22 are idler rollers which rotate freely as belt 10 moves in the direction of arrow 16.

Initially, a portion of belt 10 passes through charging station A. At charging station A, a corona generating device, indicated generally by the reference numeral 28, charges a portion of photoconductive surface 12 of belt 10 to a relatively high, substantially uniform potential.

Next, the charged portion of photoconductive surface 12 is advanced through exposure station B. At exposure station B, an original document 30 is positioned face down upon a transparent platen 32. Lamps 34 flash light rays onto original document 30. The light rays reflected from original document 30 are transmitted through lens 36 forming a light image thereof. Lens 36 focuses the light image onto the charged portion of photoconductive surface 12 to selectively dissipate the charge thereon This records an electrostatic latent image on photoconductive surface 12 which corresponds to the informational areas contained within original document 30 disposed upon transparent platen 32. Thereafter, belt 10 advances the electrostatic latent image recorded on photoconductive surface 12 to development station C.

At development station C, a magnetic brush development system, indicated generally by the reference numeral 38, transports a single component developer material comprising toner particles into contact with the electrostatic latent image recorded on photoconductive surface 12. Toner particles are furnished to development system 38 from a remote toner container 40. Blower 40 maintains the pressure in the housing of development system 38 at a lower pressure than the pressure in remote toner container 40. Particle transport 44 couples remote toner container 40 to the housing of development unit 38 and remote toner container 40 causes toner particles to be advanced by particle transport 44 from remote container 40 to the housing of developer unit 38. The detailed structure of developer unit 38 will be described hereinafter with reference to FIG. 2. The detailed structure of particle transport 44 will be described hereinafter with reference to FIGS. 3, and 4(*a*) through 4(*c*), inclusive. Developer unit 38 forms a brush of toner particles which is advanced into contact with the electrostatic latent image recorded on photoconductive surface 12 of belt 10. Toner particles are attracted to the electrostatic latent image forming a toner powder image on photoconductive surface 12 of belt 10 so as to develop the electrostatic latent image. While the foregoing describes a developer material made from particles, one skilled in the art will appreciate that other types of developer materials may also be employed, such as liquid developer materials.

After development, belt 10 advances the toner powder image to transfer station D. At transfer station D, a sheet of support material 46 is moved into contact with the toner powder image. Support material 46 is advanced to transfer station D by a sheet feeding apparatus, indicated generally by the reference numeral 48. Preferably, sheet feeding apparatus 48 includes a feed roll 50 contacting the upper most sheet of a stack of sheets 52. Feed roll 50 rotates to advance the upper most sheet from stack 50 into chute 54. Chute 54 directs the advancing sheet of support material 46 into contact with photoconductive surface 12 of belt 10 in a timed sequence so that the toner powder image developed thereon contacts the advancing sheet of support material at transfer station D.

Transfer station D includes a corona generating device 56 which sprays ions onto the backside of sheet 46. This attracts the toner powder image from photoconductive surface 12 to sheet 46. After transfer, the sheet continues to move in the direction of arrow 58 onto a conveyor 60 which moves the sheet to fusing station E.

Fusing station E includes a fuser assembly, indicated generally by the reference numeral 62, which permanently affixes the powder image to sheet 46. Preferably, fuser assembly 62 includes a heated fuser roller 64 and a back-up roller 66. Sheet 46 passes between fuser roller 64 and back-up roller 66 with the toner powder image contacting fuser roller 64. In this manner, the toner powder image is permanently affixed to sheet 46. After fusing, chute 68 guides the advancing sheet to catch tray 70 for subsequent removal from the printing machine by the operator.

Invariably, after the sheet of support material is separated from photoconductive surface 12 of belt 10, some residual particles remain adhering thereto. These residual particles are removed from photoconductive surface 12 at cleaning station F. Cleaning station F includes a pre-clean corona generating device (not shown) and a rotatably mounted fibrous brush 72 in contact with photoconductive surface 12. The pre-clean corona generator neutralizes the charge attracting the particles to the photoconductive surface. These particles are cleaned from the photoconductive surface by the rotation of brush 72 in contact therewith. Subsequent to cleaning, a discharge lamp (not shown) floods photoconductive surface 12 with light to dissipate any residual charge remaining thereon prior to the charging thereof for the next successive imaging cycle.

It is believed that the foregoing description is sufficient for purposes of the present application to illustrate the general operation of an exemplary electrophotographic printing machine incorporating the features of the present invention therein.

Referring now to FIG. 2, the detailed structure of developer unit 38 is shown thereat. The developer unit include a donor roller 74. Donor roller 74 may be a bare metal such as aluminum. Alternatively, the donor roller may be a metal roller coated with a thick material. By way of example, a polytetrafluoroethylene based resin such as Teflon, a trademark of the DuPont Corporation, or a polyvinylidene fluoride based resin, such as Kynar, a trademark of the Pennwalt Corporation, may be used to coat the metal roller. This coating acts to assist in charging the particles adhering to the surface thereof. Still another type of donor roller may be made from stainless steel plated by a catalytic nickel generation process and impregnated with Teflon. The surface of the donor roller is roughened from a fraction of a micron to several microns, peak to peak. An electrical bias is applied to the donor roller of about 600 volts for coatings up to 0.5 millimeters thick. Donor roller 74 is coupled to a motor which rotates donor roller 74 in the direction of arrow 76. Donor roller 74 is positioned, at least partially, in chamber 78 of housing 80. Particle transport 44 has the exit portion thereof in chamber 78 of housing 80 so as to advance toner particles thereto. In this way, housing 78 contains a continuous supply of toner particles which are received by donor 74 and advanced, in the direction of arrow 76, into contact with the electrostatic latent image recorded on photoconductive surface 12 of belt 10. As donor roller 74 rotates in the direction of arrow 76, charging blade 82 has the region of the free end thereof resiliently urged into contact with donor roller 74. Charging blade 82 may be made from a metal, Silicone rubber, or a plastic materia. By way of example, charging blade 82 may be made from steel phosphor bronze and ranges from about 0.025 millimeters to about 0.25 millimeters in thickness, being a maximum of 25 millimeters wide. The free end to the changing blade extends beyond the tangential contact point with donor roller 74 by about 4 millimeters or less. Charging blade 82 is maintained in contact with donor roller 74 at a pressure ranging from about 10 grams per centimeter to about 250 grams per centimeter. The toner particle layer adhering to donor roller 74 is charged to a maximum of 60 microcoulombs with the toner mass adhering thereto ranging from about 0.1 milligrams per centimeter$^2$ to about 2 milligrams per centimeter$^2$ of roll surface. It is thus seen that transport 44 continually furnishes toner particles to chamber 78 of housing 80 so that donor roller 74 transports these toner particles in the direction of arrow 76. The toner particles adhering to donor roller 74 are charged by charging blade 82 prior to advancing into contact with the electrostatic latent image recorded on photoconductive surface 12. These toner particles are attracted to the electrostatic latent image to form a toner powder image on photoconductive surface 12 of belt 10. The detailed structure of particle transport 44 will be described hereinafter with reference to FIGS. 3 and 4(*a*) through 4(*c*), inclusive.

Turning now to FIG. 3, there is shown particle transport 44 in greater detail. As depicted thereat, particle transport 44 connects remote toner container 40 (FIG. 1) to chamber 78 of housing 80 of developer unit 38. Toner particles stored in chamber 84 of remote container 40 are advanced by particle transport 44 in the direction of arrow 86 to chamber 78 of housing 80. Blower 42 (FIG. 1) coupled to chamber 78 of housing 80 maintains chamber 78 at a lower pressure than chamber 84 of remote container 40. Particle transport 44 includes an elongated duct 88, preferably tubular in shape, which has an entrance region in chamber 84 and an exit region in chamber 78. An elongated member 90 is mounted interiorly of duct 88. Elongated member 90 rotates and fluidizes the toner particles in duct 88. Elongated member 90 is adapted to only fluidize the particles. Normally, elongated member 90 imparts substantially no longitudinal movement to the toner particles. The major requirements of elongated member 90 is to have no helical symmetry so that the toner particles can readily move in either direction after being fluidized with the direction of movement being dependent upon the pressure gradient. However, increases in the packing and caking of toner particles in the duct preceding a jamming failure increase the torque needed to turn the elongated member. This increase in torque can deflect the elongated member inducing a helical twist therein. The helical twist in the elongated member starts the toner particles moving in a preferential direction. The direction of movement can be such as to increase the packing and caking of the toner particles causing failure of the system, or, in the opposite direction, to relieve the packing and caking of the toner particles and to reduce the torque on the elongated member. To achieve the desired effect wherein the toner particles are moved back toward the remote toner container away from the packed and caked toner particles in the duct, the external torque delivery point has to be located at end 92 of elongated member 90. Thus, the motor rotating elongated member 90 should be connected at end 92. Alternatively, if it is desired to position the drive motor at end 94 of elongated member 90, the torque delivery point must be located at end 92. Thus, until packing or caking of the toner particles reaches a level sufficient to deflect elongated member 90 helically, the fluidized toner particles move in the direction of arrow 86 due to the pressure differential between chamber 78 and chamber 84. However, after deflection the toner particles move in the opposite direction to that of arrow 86. This relieves packing and caking of the toner particles and reduces the torque exerted on the elongated member so that the elongated member returns automatically to its undeflected state. One skilled in the art will appreciate that gravity may be used to move the fluidized particles as long as the toner level in chamber 78 is lower than that of chamber 84. In this way, the fluidized toner particles move from the entrance region of duct 88 in chamber 84 of remote container 40 to the exit region thereof in chamber 78 of housing 80. Thus, a continuous supply of toner particles is furnished from remote container 40 to housing 80 of developer unit 38. Elongated member 90 extends under or along roller 74 to facilitate the deposition of toner particles on roller 74. The detailed structure of elongated member 90 will be described hereinafter with reference to FIGS. 4(*a*) through 4(*c*), inclusive.

FIGS. 4(*a*) through 4(*c*), inclusive show various embodiments of elongated member 90. Referring initially to FIG. 4(*a*), there is shown one embodiment of elongated member 90. As depicted thereat, elongated member 90 includes a rod 96 having a plurality of equally spaced rectangularly shaped paddles 98 extending outwardly therefrom. Each paddle is spaced from the next adjacent paddle by about 90°. As elongated member 90 rotates, the paddles fluidize the toner particles in duct 88. This permits the toner particles to advance along duct 88, in the direction of arrow 86, due to the pressure differential between the remote toner container and the developer unit. The drive motor is connected to end 92 of rod 96. When caking and packing of the toner particles in duct 88 reaches a preselected level, i.e. where the torque applied on elongated member 90 is at a preselected level, elongated member 90 starts to deflect or twist into a helix about end 92. This causes paddles 98 to also twist into a helix. As elongated member 90 continues to rotate, the helical twist in paddles 98 causes the toner particles to move away from the packed and caked toner particles back to the remote toner container in a direction opposite to that of arrow 86 (FIG. 3). This gradually reduces the torque exerted on elongated member 90 allowing it to return to the undeflected state. In this way, the caking and packing of the toner particles in the duct is automatically relieved.

Turning now to FIG. 4(*b*), there is shown another embodiment of an elongated member 90. As depicted thereat, elongated member 90 includes a rod 100 having a tube or sleeve 102 mounted slidably thereon. Sleeve 102 has a plurality of equally spaced rectangularly shaped paddles 104 extending outwardly therefrom. Each paddle is spaced from the next adjacent paddle by about 90°. Sleeve 102 is connected by a pin 106 to rod 100 at end 92. The drive motor is connected to rod 100 at end 94 thereof. As elongated member 90 rotates, the paddles fluidize the toner particles in duct 88. This permits the toner particles to advance along duct 88, in the direction of arrow 86, due to the pressure differential between the remote toner container and the developer unit. When caking and packing of the toner particles in duct 88 reaches a preselected level, i.e. where the torque applied on sleeve 102 is at a preselected level, sleeve 102 starts to deflect or twist into a helix about pin 106 on end 92 of rod 100. This causes the paddles 104 to twist into a helix as well. As elongated member 90 continues to rotate, the helical twist in paddles 104 of sleeve 102 causes the toner particles to move away from the packed and caked toner particles back to the remote toner container in a direction opposite to that of arrow 86 (FIG. 3). As the packing and caking condition is relieved, the torque on the sleeve is reduced and it returns to the undeflected condition.

One skilled in the art will appreciate that under certain circumstances it may be desirable to have the paddles mounted in a slight helix so as to assist in moving the particles from the remote storage unit to the developer unit. Under these circumstances, caking and packing of the toner particles will cause the paddles to deflect sufficiently to reverse the angle of the helix so that the toner particles are returned to the storage container.

Still another embodiment of elongated member 90 is depicted in FIG. 4(*c*). As depicted therein, elongated member 90 includes a cylindrical member 108 mounted slidably on shaft 112 and having a plurality of pins 110 extending outwardly therefrom. Pins 110 are disposed radially with respect to the axis of shaft 112. Pins 110 are located in an array on cylinder 108 and positioned so as to normally have no helical character when in an undeflected condition. Cylinder 108 is connected to shaft 112 at end 92 by suitable means such as a pin. The drive motor is connected to end 94 of elongated member 90. As elongated member 90 rotates, the pins fluidize the toner particles in duct 88. This permits the toner particles to advance along duct 88, in the direction of arrow 86, due to the pressure differential between the remote toner container and the developer unit. When caking and packing of the toner particles in duct 88 reaches a preselected level, i.e. where the torque applied on pins is at a preselected level, cylinder 108 starts to deflect or twist into a helix about end 92. This causes the pins 110 to twist into a helix as well. The pins are spaced a distance from one another such that the helical twist formed therein causes the adjacent pins to act as a continous paddle. As elongated member 90 continues to rotate, the helically twisted pins move the toner particles away from the packed and caked toner particles back to the remote toner container in a direction opposite to that of arrow 86 (FIG. 3). This automatically relieves caking and packing of the toner particles in the duct and reduces the torque exerted on the pins causing the elongated member to resume its normal undeflected condition.

One skilled in the art will appreciate that while the particle transport of the present invention has been illustrated as advancing toner particles from a remote toner container to a developer unit, this particle transport may be employed to move granular particles from an entrance region to an exit region irrespective of the type of device that it is employed in. For example, in an electrophotographic printing machine, the particle transport may also be used to transport residual particles from the cleaning housing to a remote container for subsequent removal from the printing machine. A particle transport of the type depicted in the present invention enables the particles to be moved from any remote location to any other location without the occurrence of jamming due to particle caking and packing.

In recapitulation, it is clear that the particle transport of the present invention includes a duct having an entrance and exit portion therein. The duct has an elongated member disposed interiorly thereof for fluidizing toner particles received in the entrance region. A pressure differential is maintained between the exit region and the entrance region of the duct. This pressure differential moves the fluidized toner particles along the duct from the entrance region to the exit region thereof independent of the orientation of the duct with respect to gravitational forces. If the toner particles pack and cake together, the torque on the elongated member increases causing the elongated member to deflect or twist into a helix. With continued rotation of the elongated member, the helix induced therein causes the toner particles to move away from the region of the packed and caked toner particles back toward the remote toner container relieving the condition and reducing the torque on the elongated member so that it may return to the undeflected condition.

It is, therefore, evident that there has been provided, in accordance with the present invention a particle transport that fully satisfies the aims and advantages hereinbefore set forth. While this invention has been described in conjunction with various embodiments thereof, it is evident that many alternatives, modifications and variations will be apparent to those skilled in the art. Accordingly, it is intended to embrace all such alternatives, modifications and variations as fall within the spirit and broad scope of the appended claims.

I claim:

1. An apparatus arranged for use in an electrophotographic printing machine for moving developer material from a storage container located at one end of a duct to a developer unit located at the other end thereof, including:

an elongated member disposed interiorly of the duct;

means for moving said elongated member to fluidize the developer material in the duct, said elongated member, in response to the torque applied thereon by packing of the developer material, deflecting so that continued movement of said elongated member reduces the torque applied thereon by returning the developer material to the storage container; and means for normally advancing the fluidized developer material in the duct from the storage container located at one end of the duct to the developer unit located at the other end of the duct.

2. An apparatus according to claim 1, wherein said advancing means includes means for generating a pressure differential to normally move the fluidized developer material in the duct from the storage container located at one end of the duct to the developer unit located at the other end of the duct.

3. An apparatus according to claim 2, wherein said elongated member deflects to form a helical shape for moving the developer material back toward the storage container.

4. An apparatus according to claim 3, wherein the duct is a tube.

5. An apparatus according to claim 4, wherein said moving means rotates said elongated member.

6. An apparatus according to claim 5, wherein said elongated member includes:

a rod; and a sleeve mounted slidably on said rod and being secured to said rod at one end thereof with the other end of said rod being coupled to said moving means, said sleeve, in response to the torque exerted thereon by the developer material, deflects helically in a direction to move the developer material toward the storage container to relieve packing of the developer material and reduce the torque applied on said sleeve.

7. An apparatus according to claim 5, wherein said elongated member includes a rod with a multiplicity of pins extending outwardly therefrom, said rod being coupled to said moving means so as to deflect in a direction such that the pins extending outwardly therefrom form a helical array which moves the developer material toward the storage container to relieve packing of the developer material and reduce the torque applied on said rod.

8. An apparatus according to claim 5, wherein said elongated member includes a rod having a plurality spaced paddles extending outwardly therefrom, said rod being coupled to said moving means so as to deflect in a direction such that the paddles extending outwardly therefrom form a helical array which moves the developer material toward the storage container to relieve packing of the developer material and reduce the torque applied on said rod.

9. An electrophotographic printing machine of the type having an electrostatic latent image recorded on a photoconductive member in which developer material is moved from a storage container located at one end of a duct to a developer unit located at the other end thereof for development of the electrostatic latent image; wherein the improvement includes:

an elongated member disposed interiorly of the duct;

means for moving said elongated member to fluidize the developer material in the duct, said elongated member, in response to the torque applied thereon by packing of the developer material, deflecting so that continued movement of said elongated member reduces the torque applied thereon by returning the developer material to the storage container; and means for normally advancing the fluidized developer material in the duct from the storage container located at one end of the duct to the developer unit located at the other end of the duct.

10. A printing machine according to claim 9, wherein said advancing means includes means for generating a pressure differential to normally move the fluidized developer material in the duct from the storage container located at one end of the duct to the developer unit located at the other end of the duct.

11. A printing machine according to claim 10, wherein said elongated member deflects to form a helical shape for moving the developer material back toward the storage container.

12. A printing machine according to claim 11, wherein the duct is a tube.

13. A printing machine according to claim 12, wherein said moving means rotates said elongated member.

14. A printing machine according to claim 13, wherein said elongated member includes:

a rod; and a sleeve mounted slidably on said rod and being secured to said rod at one end thereof with the other end of said rod being coupled to said moving means, said sleeve, in response to the torque exerted thereon by the developer material, deflects helically in a direction to move the developer material toward the storage container to relieve packing of the developer material and reduce the torque applied on said sleeve.

15. A printing machine according to claim 13, wherein said elongated member includes a rod with a multiplicity of pins extending outwardly therefrom, said rod being coupled to said moving means so as to deflect in a direction such that the pins extending outwardly therefrom form a helical array which moves the developer material toward the storage container to relieve packing of the developer material and reduce the torque applied on said rod.

16. A printing machine according to claim 13, wherein said elongated member includes a rod having a plurality spaced paddles extending outwardly therefrom, said rod being coupled to said moving means so as to deflect in a direction such that the paddles extending outwardly therefrom form a helical array which moves the developer material toward the storage container to relieve packing of the developer material and reduce the torque applied on said rod means.

* * * * *